US009630812B1

(12) United States Patent
Galway

(10) Patent No.: US 9,630,812 B1
(45) Date of Patent: Apr. 25, 2017

(54) LOAD TRANSFER ACCESSORY FOR DIMINISHING UNWANTED MOTION OF CYLINDRICAL CARGO DURING LOADING OPERATIONS

(71) Applicant: Robert J. Galway, Virginia Beach, VA (US)

(72) Inventor: Robert J. Galway, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 253 days.

(21) Appl. No.: 14/548,428

(22) Filed: Nov. 20, 2014

Related U.S. Application Data

(60) Provisional application No. 62/057,729, filed on Sep. 30, 2014.

(51) Int. Cl.

| | |
|---|---|
| ***B66C 23/00*** | (2006.01) |
| ***B66C 13/06*** | (2006.01) |
| ***B63B 27/10*** | (2006.01) |
| ***B66C 23/02*** | (2006.01) |

(52) U.S. Cl.
CPC ..... *B66C 13/06* (2013.01); *B63B 27/10* (2013.01); *B66C 23/02* (2013.01); *B66C 23/00* (2013.01)

(58) Field of Classification Search
CPC ..... B66C 23/00; B66C 23/18; B66C 23/52; B66C 23/525; B66C 23/60; B66C 23/605; B66C 23/62; B66C 23/64; B66C 23/66; B66C 23/88; B66C 23/90; B62C 1/62
See application file for complete search history.

(56) References Cited

U.S. PATENT DOCUMENTS

| | | | | |
|---|---|---|---|---|
| 4,126,235 | A | 11/1978 | Wirt | |
| 4,828,125 | A | 5/1989 | Svedaker | |
| 8,721,248 | B2 | 5/2014 | Jonsson | |
| 8,794,457 | B2 | 8/2014 | Richter | |
| 2001/0020435 | A1* | 9/2001 | Ghignone | B63B 27/36 114/322 |
| 2002/0166998 | A1* | 11/2002 | Selcer | B63B 21/66 254/333 |
| 2014/0377004 | A1* | 12/2014 | Lossec | B63B 23/40 405/3 |

* cited by examiner

*Primary Examiner* — Sang Kim
*Assistant Examiner* — Juan Campos, Jr.
(74) *Attorney, Agent, or Firm* — Dave A. Ghatt

(57) ABSTRACT

A load transfer accessory for a loading apparatus such as a crane. The load transfer accessory is a holding mechanism that reduces unwanted movement in cylindrical cargos. The holding mechanism includes an attachment frame, a receiving member and an indexing clutch. The receiving member includes a curved surface for receiving the cylindrical cargo. The indexing clutch can be adjustably locked by wire rope tension to clock the receiving member in a desired angular orientation for loading operations.

11 Claims, 6 Drawing Sheets

LOAD TRANSFER ACCESSORY FOR DIMINISHING UNWANTED MOTION OF CYLINDRICAL CARGO DURING LOADING OPERATIONS

CROSS-REFERENCE TO RELATED APPLICATIONS

This application claims the benefit of U.S. Provisional Application No. 62/057,729, filed Sep. 30, 2014, titled "Load Transfer Accessory For Diminishing Unwanted Motion Of Cylindrical Cargo During Loading Operations", incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a load transfer accessory for a loading apparatus such as a crane. More specifically, the load transfer accessory controls and reduces unwanted movement in cylindrical cargo during loading operations.

BACKGROUND

Load transfer apparatuses such as cranes typically use hooks and other known fastening devices to secure loads to the device, after which the fastened load is lifted from an original position and transferred to a desired position. One common problem associated with load transfer apparatuses is that the lifted load tends to swing freely, like a pendulum. When cargo swings in this manner, difficulty will naturally be experienced in transferring and lowering the cargo accurately to the desired position.

This problem is compounded when the cargo is delicate or a special care item. Additionally, cargo articles having different shapes may each display unique balance-related swinging motions on account of their respective shapes. For example, cargo having cylindrical shapes may swing more uncontrollably because of the elongated longitudinal axis. Preventing unwanted cargo swinging is further compounded in situations when the load transfer apparatus is mounted on a water vessel, such as a barge or small boat, or the like. There is more movement not associated with land-based operations because the load transfer apparatus is on water, even when the water is calm. Thus, it is desired to have a load transfer apparatus that reduces undesired movement of the load during load transfer operations, particularly undesired movement associated with loads having cylindrical shapes.

SUMMARY

In one aspect, the invention is a load transferring apparatus having a boom and a jib pivotally attached to the boom. The load transferring apparatus also includes a holding mechanism for controllably receiving cylindrical cargo and diminishing undesired motion of said cylindrical cargo. In this aspect, the holding mechanism has an attachment frame pivotally attached at a pivot point to the jib. The holding mechanism also includes a receiving member for receiving cylindrical cargo thereon. The receiving member has a curved inner surface, wherein the curved inner surface has a radius of curvature that is substantially equal to the radius of curvature of said cylindrical cargo. In this aspect, the holding mechanism also includes an indexing clutch or connected to and between the attachment frame and the receiving member. The indexing clutch has an upper plate having a bottom surface having a plurality of downward projecting ridges, and a lower plate having a top surface having a plurality of upward projecting ridges for mating with the downward projecting ridges of the upper member to lock the upper plate with respect to the lower member at different positions to clock the receiving member in a desired angular orientation. Each of the attachment frame, the upper and lower plates of the indexing arrangement, and the receiving member have a central opening that forms a central pathway. In this aspect the load transfer apparatus also has a winch, and a cable having a hook at one end and attached to the winch at another. The cable extends from the winch at one end through the central pathway, with the hook positioned below the receiving member for hooking the cylindrical cargo. In this aspect, when the winch is activated the cylindrical cargo is pulled against the receiving member, thereby holding said cylindrical cargo against the curved inner surface.

In another aspect, the invention is a holding mechanism for controllably receiving cylindrical cargo and diminishing undesired motion of said cylindrical cargo. The holding mechanism has an attachment frame pivotally attached at a pivot point to a jib of a load transferring apparatus. In this aspect, the holding mechanism also includes a receiving member for receiving cylindrical cargo thereon, the receiving member having a curved inner surface, wherein the curved inner surface has a radius of curvature that is substantially equal to the radius of curvature of the cylindrical cargo. The holding mechanism also includes an indexing clutch connected to and between the attachment frame and the receiving member. The indexing clutch has an upper plate having a bottom surface having a plurality of downward projecting ridges, and a lower plate having a top surface having a plurality of upward projecting ridges for mating with the downward projecting ridges of the upper member to lock the upper plate with respect to the lower member at different positions to clock the receiving member in a desired angular orientation. Each of the attachment frame, the upper and lower plates of the indexing arrangement, and the receiving member have a central opening that forms a central pathway. In this aspect, the holding mechanism also has a cable having a hook at one end and attached to a winch at another. The cable extends from the winch at one end through the central pathway, with the hook positioned below the receiving member for hooking the cylindrical cargo. When the winch is activated the cylindrical cargo is pulled against the receiving member, thereby holding the cylindrical cargo against the curved inner surface.

BRIEF DESCRIPTION OF THE DRAWINGS

Other features will be apparent from the description, the drawings, and the claims.

DETAILED DESCRIPTION

Figure 1:
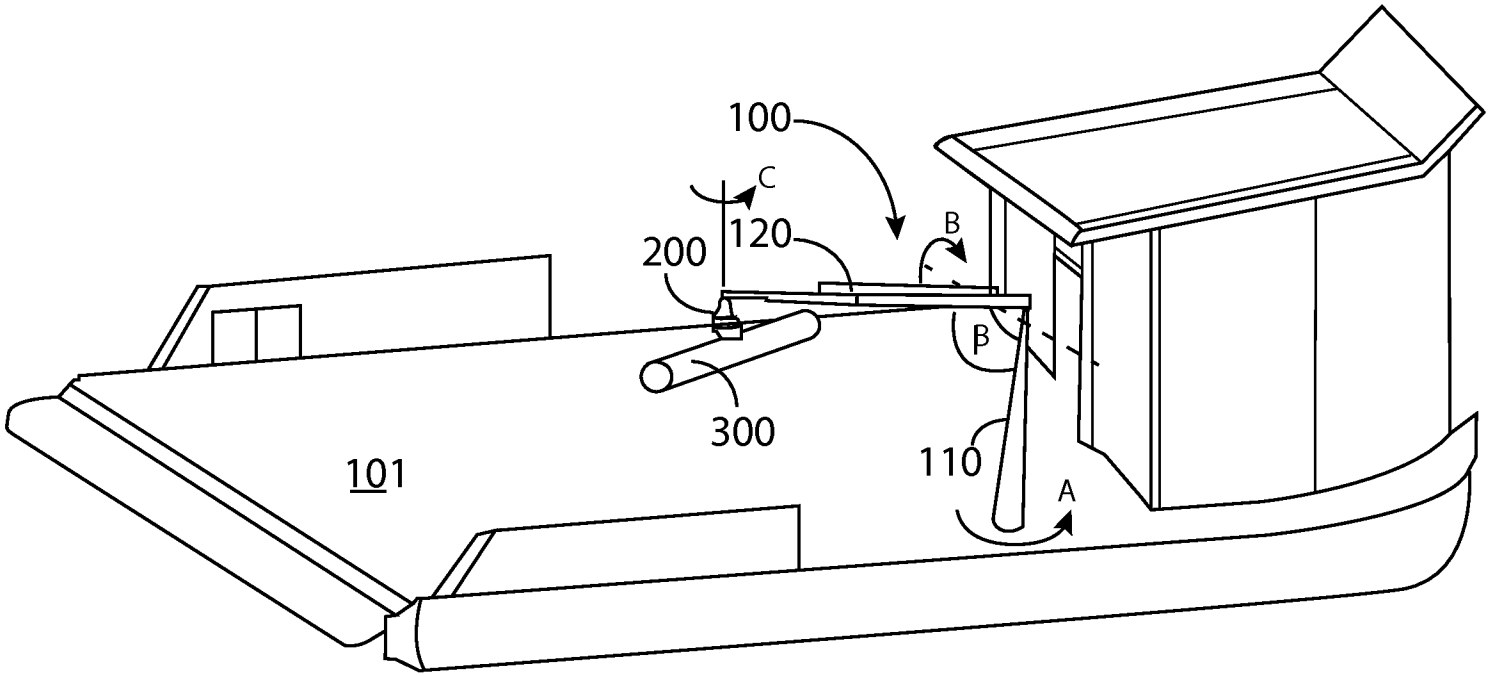
FIG. 1 is an exemplary schematic illustration of a load transfer apparatus having a holding mechanism for controllably receiving cylindrical cargo, according to an embodiment of the invention.

FIG. 1 is an exemplary schematic illustration of a load transfer apparatus 100 having a holding mechanism 200 for controllably receiving cylindrical cargo 300 and diminishing undesired motion, according to an embodiment of the invention. As shown, the load transfer apparatus 100 is a crane, but according to other embodiments may be any other known load transfer apparatus. According to this particular embodiment, the crane 100 is an extending boom crane having a boom 110, which as in known in cranes and as illustrated, is rotatable in direction A. A jib 120 is pivotally attached to the boom 110, partially rotatable in direction B, adjusting the angle β between the boom 110 and the jib 120. FIG. 1 shows the load transfer accessory, holding mechanism 200 attached at the end of the jib 120. FIG. 1 also shows a cable 130 that extends through the holding mechanism. In combination with the cable 130, the holding mechanism 200 holds the cylindrical cargo 300 at a surface of the holding mechanism and provides control of unwanted swaying in direction C. The cylindrical cargo 300 may be any type of cargo having a cylindrical shape, such as a container, a construction pipe, or a water vessel such as an unmanned underwater vessel.

As shown, the load transfer apparatus 100 is mounted on a platform 101. According to an embodiment of the invention, the platform 101 is a floating platform such as a barge or small boat or other vessel that is on open water. As outlined below, the load transfer apparatus 100 equipped with the holding mechanism 200 is structured to controllably receive cylindrical cargo 300, preventing undesired swinging of the cylindrical cargo 300, even in embodiments when conditions are difficult because the load transferring operations being performed on open water. It should be noted that in embodiments in which the platform 101 is floating on open water, the adjustability outlined above, such as the ability to rotate in directions A and B facilitates easy loading. For example, the rotation direction B, which adjusts the angle β between the boom 110 and the jib 120, facilitates the capturing of loads below in the water, when angle β is less than 90 degrees.

Figure 2:
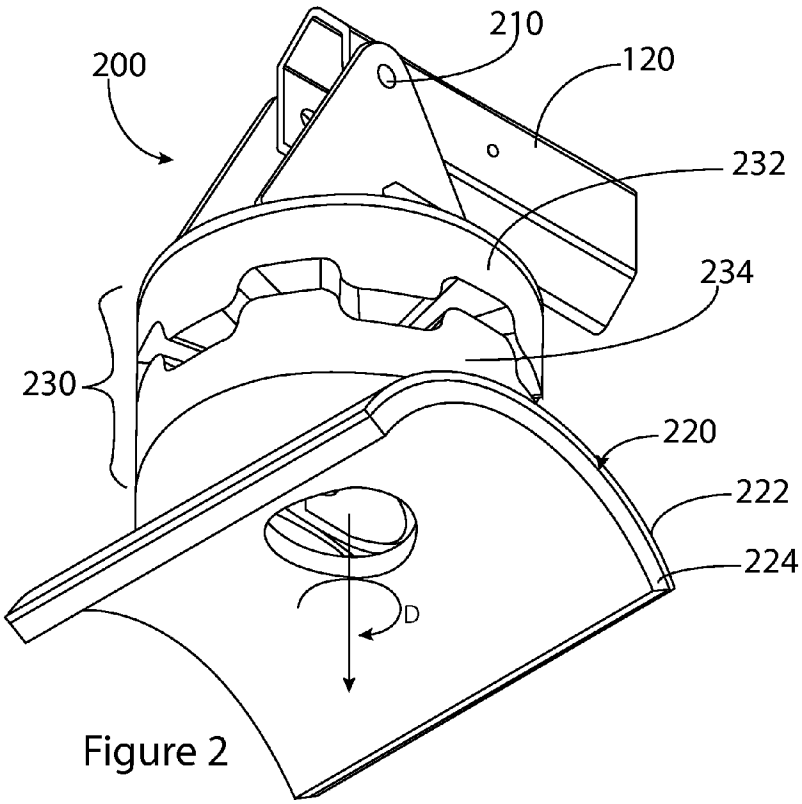
FIG. 2 is an exemplary perspective illustration of a holding mechanism for controllably receiving cylindrical cargo, according to an embodiment of the invention.

FIG. 2 is an exemplary perspective illustration of a load transfer accessory, holding mechanism 200, for controllably receiving cylindrical cargo 300 and diminishing undesired motion, according to an embodiment of the invention. According to one embodiment, the holding mechanism 200 is designed as an accessory to the crane 100, which according to this embodiment is an extending boom crane. According to this embodiment, the holding mechanism 200 may be quickly installed when the mission dictates the at-sea recovery of a cylindrical load, such as a water vessel. Thus the standard crane hook may be removed and the holding mechanism 200 may be used by inserting an attachment device, such as a pin 211 (shown in FIGS. 3 and 5).

As shown, the holding mechanism 200 has an attachment frame 210 which attaches the holding mechanism 200 to the load transfer apparatus 100. FIG. 2 shows the attachment frame 210 pivotally attached to the jib 120. As outlined below, unwanted pivoting between the attachment frame 210 and the jib is significantly reduced by the tensioning of the cable 130 and the weight of the cylindrical cargo 300.

FIG. 2 also shows the holding mechanism 200 having a receiving member 220 for receiving cylindrical cargo 300 thereon. The receiving member 220 has a curved outer shell 222 that may be made from a hard material such as a metal or a composite material. The receiving member 220 also has a curved inner surface 224 that is made from a thick firm foam material. The curved inner surface 224 makes contact with the cylindrical cargo 300 when the load 300 is held by the holding mechanism 200. The foam may be a firm foam material, such as a low density polyethylene covered by a polyurethane top coat.

Figure 3:
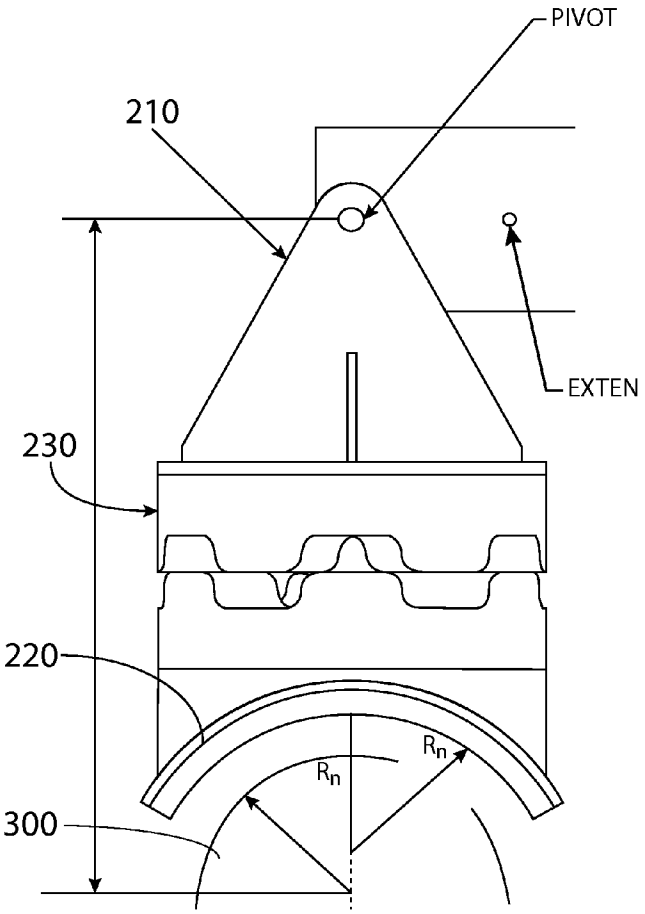
FIG. 3 is an exemplary side view of the receiving member and a cylindrical cargo, according to an embodiment of the invention.

In order to properly receive the cylindrical cargo 300, the curvature of the receiving member 220 must match the curvature of the cylindrical cargo 300. Consequently, each of the curved outer shell 222 and the curved inner surface 224 have a radius of curvature that is substantially equal to the radius of curvature of the cylindrical cargo 300. FIG. 3 is an exemplary side view of the receiving member 220 and a cylindrical cargo 300, showing substantially the surfaces 222 and 224 having a radius of curvature that is substantially equal to the radius of curvature of the cylindrical cargo. FIG. 3 shows both the receiving member 220 and the cylindrical cargo having a radius of curvature Rn, where n is any desired value. According to one embodiment, n=8.63.

Returning to FIG. 2, as illustrated, the holding mechanism also includes an indexing clutch 230. As shown the indexing clutch 230 is positioned between the attachment frame 210 and the receiving member 220. FIG. 2 shows the indexing clutch 230 having an upper plate 232 and a lower plate 234 rotatably indexable with respect to each other. Both the upper and lower plates 232 and 234 may preferably be a solid foam material, such as a low density polyethylene covered by a polyurethane top coat. The height of the indexing clutch teeth may be adjusted to suit the resistance to rotation required by the dynamic forces associated with the platform 101 in a seaway and the tendency of the load 300 to rotate and sway in an uncontrolled manner. As outlined below the plates 232 and 234 are used to rotate the receiving member 220 to a desired orientation about an axis Y, as shown by arrow D. According to an embodiment of the invention, the upper and lower plates 232 and 234 may be rotated manually.

Figure 4:
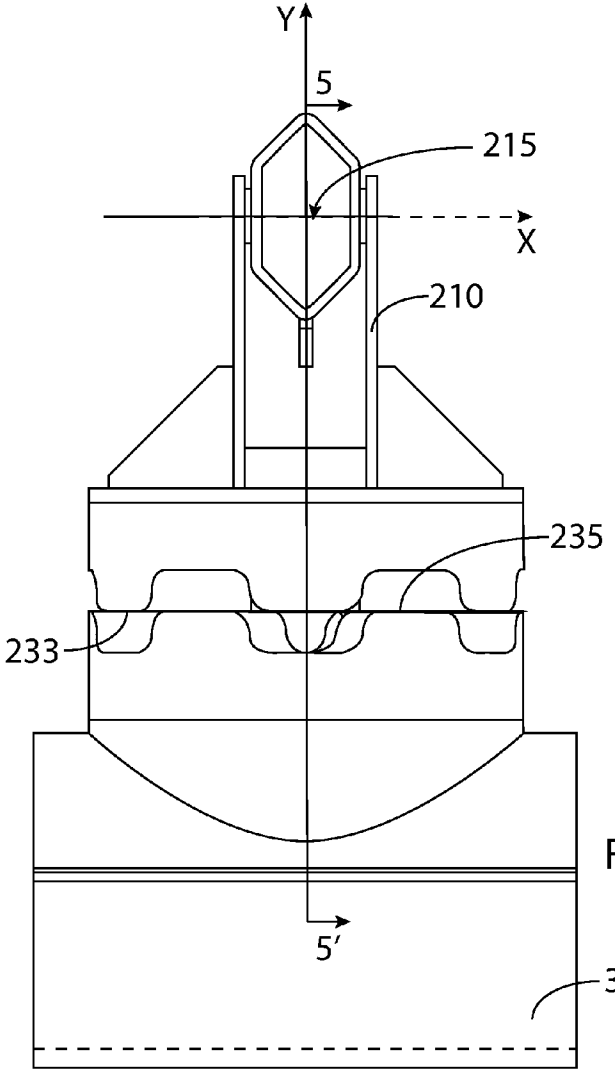
FIG. 4 is an exemplary side view of a holding mechanism for controllably receiving cylindrical cargo, according to an embodiment of the invention.

FIG. 4 is an exemplary side view of a holding mechanism 200, including the indexing clutch 230, for controllably receiving cylindrical cargo 300 and diminishing undesired motion, according to an embodiment of the invention. FIG. 4 shows the indexing clutch 230 having an upper plate 232 and a lower plate 234. As shown, the upper plate 232 has a bottom surface with a plurality of downward projecting ridges 233. FIG. 4 also shows a lower plate having a top surface having a plurality of upward projecting ridges 235 for mating with the downward projecting ridges 233 of the upper plate 232. The respective downward projecting ridges 233 and upward projecting ridges 235 mate to clock the upper member 232 with respect to the lower member 234 at different angular positions.

FIG. 4 also shows the Y axis extending through the holding mechanism 200. As stated above, the plates 232 and 234, with respective interlocking ridges 233 and 235 are used to rotate the receiving member 220 to a desired angular orientation about the axis Y, so that the receiving member aligns with the cylindrical cargo 300. FIG. 4 also shows an X axis extending through a pivot point 215, about which the holding mechanism 200 is pivotally mounted, via the attachment frame 210. FIG. 4 also shows the cylindrical cargo 300 cradled against foam curved inner surface 224 of the receiving member 220.

Figure 5:
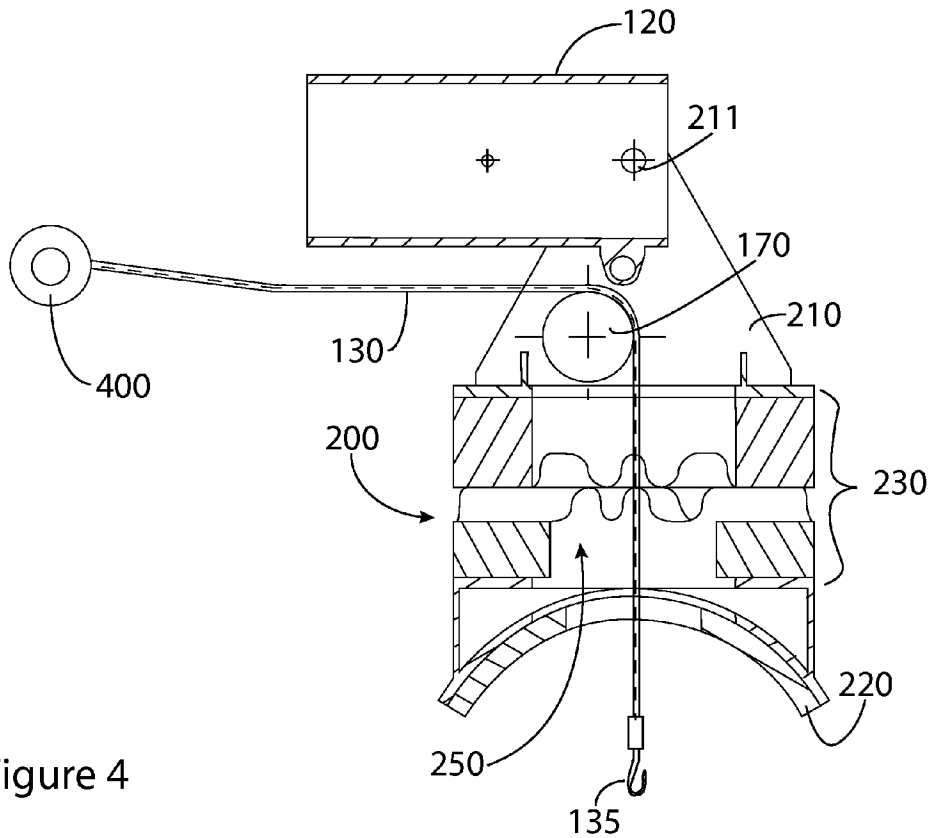
FIG. 5 is an exemplary section view of a holding mechanism for controllably receiving cylindrical cargo, according to an embodiment of the invention.

FIG. 5 is an exemplary section view of the holding mechanism 200 for controllably receiving cylindrical cargo 300 and diminishing undesired motion, according to an embodiment of the invention. The FIG. 5 sectional view is through 5-5' shown in FIG. 4. FIG. 5 also shows how the cylindrical cargo 300 is cradled into the receiving member 220.

FIG. 5 shows, the attachment frame 210, the receiving member 220, and the indexing clutch 230. FIG. 5 also shows each of the attachment frame 210, the receiving member 220, and the indexing clutch 230 having respective central openings, forming a central pathway 250. Regarding the indexing clutch 230, each of the upper and lower plates 232 and 234 have openings. FIG. 5 shows the cable 130 extending through the central pathway 250. At one end, the cable 130 has a hook 135. The hook end of the cable 130 extends out of the receiving member 220. The other end of the cable 130 is attached to a winch 400, which may be positioned on the load transfer apparatus 100. As outlined below, the winch 400 may be activated to control the cable 130, and any load attached to the cable 130. FIG. 5 shows the cable wrapped around a wheel 170 in the attachment frame 210, the wheel 170 redirecting the path of the cable 130 towards the winch 400. Although FIG. 5 shows one wheel 170, more than one wheel may be used to redirect the cable 130 as desired.

Figure 6A:
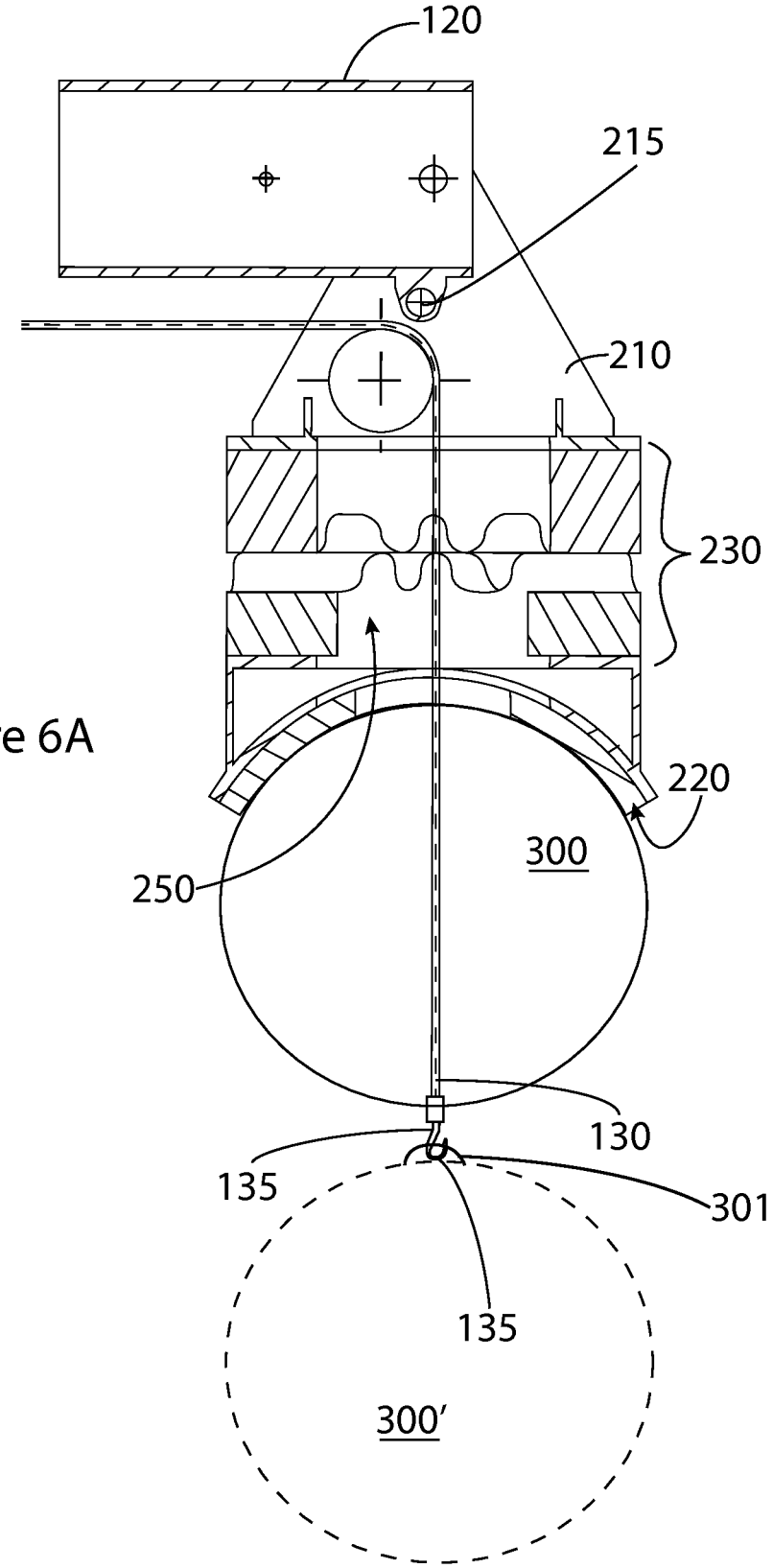
FIG. 6A is an exemplary section view showing the operation of the holding mechanism, according to an embodiment of the invention.

FIG. 6A is an exemplary section view showing the operation of the holding mechanism 200, according to an embodiment of the invention. FIG. 6A shows the cable 130 extending through the central pathway 250. FIG. 6 shows the cable 130 and hook 135 in a first position being attached to a corresponding connection ring 301 on the cylindrical cargo 300, shown in dotted lines. FIG. 6A also shows the cable 130 and hook 135 in a cradled second position (in solid lines) against the receiving member 220. In operation, the hook 135 is attached to the connection ring 301, and the winch 400 is activated and draws the cylindrical cargo 300 upwards until it contacts the foam curved inner surface 224 of the receiving member 220.

It should be noted that at some point before the cable 130 pulls in the cylindrical cargo 300 against the receiving member 220, the indexing clutch 230 is adjusted to align the receiving member 220 with the cylindrical cargo 300. As outlined above, the upper and lower plates 232 and 234 are rotated with respect to each other, locking the respective downward projecting ridges 233 and upward projecting ridges 235, clocking the upper member 232 with respect to the lower member 234 at a desired angular orientation. This results in the receiving member 220 being oriented about the Y axis, in proper alignment with the cylindrical cargo 300. With this alignment, the cylindrical cargo 300 is properly cradled within the receiving member 220, and because the receiving member 220 and the cylindrical cargo 300 have substantially the same radius of curvature Rn, the cradling is precise, which adds stability to the load transfer process, diminishing undesired rocking or swaying of the cylindrical cargo 300.

Figure 6B:
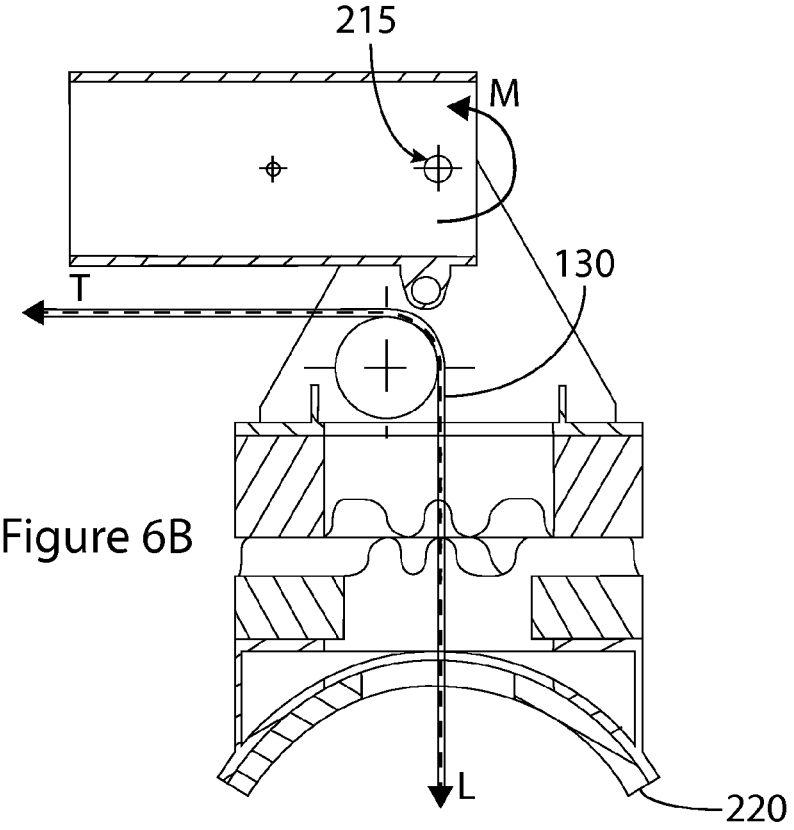
FIG. 6B is an exemplary section view showing the operation of the holding mechanism, with the cylindrical cargo cradled against the inner surface of the receiving member, according to an embodiment of the invention.

FIG. 6B is an explanatory illustration, outlining the operation of the holding mechanism 200, when the cylindrical cargo 300 is cradled against the inner surface 224 of the receiving member 220 (as shown in FIG. 6A), according to an embodiment of the invention. The explanatory view of FIG. 6B also shows the attachment frame 210 pivotally connected to the jib 220 at the pivot point 215, about which the holding mechanism 200 is structured to pivot, about the X axis (shown in FIGS. 5 and 6A). The holding apparatus 200 in combination with the load transfer apparatus 100 diminishes undesired motion of the cylindrical cargo 300.

FIG. 6B illustrates how different interacting forces help to limit the motion of the cylindrical cargo 300. FIG. 6B shows a force L that is created by the cylindrical cargo 300 pressing against the receiving member 220. FIG. 6B also shows the tension T in the cable 130 due to the pulling by the winch 400. The tension T counterbalances the force L of the cargo 300. These forces T and L create a moment M about the pivot point 215 which substantially prevents undesired rotation/motion of the holding mechanism 200 about the pivot point 215. In other words, the moment M prevents free swinging of the holding mechanism 200, keeping the holding mechanism steady. According to other embodiments, the holding mechanism 200 or the jib 120 may include on or more complementary abutting members that physically prevent the rotation of the holding mechanism 200 about the pivot point 215.

Figure 6C:
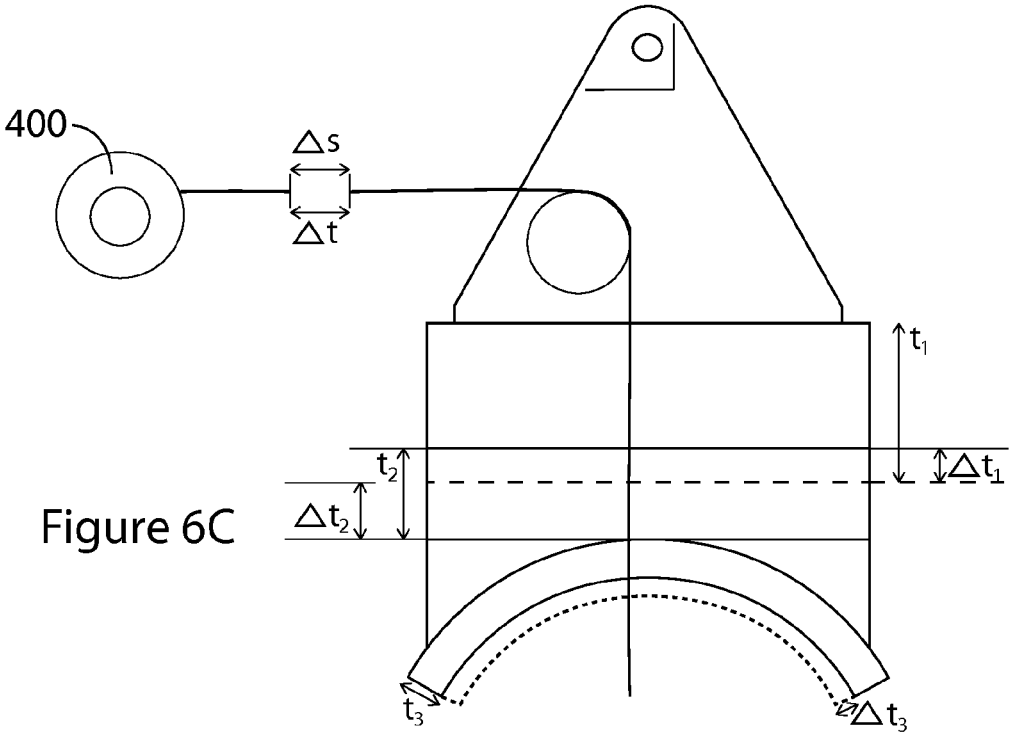
FIG. 6C is an explanatory illustration, outlining the operation of the holding mechanism, when the cylindrical cargo is cradled against the inner surface of the receiving member (as shown in FIG. 6A), according to an embodiment of the invention.

FIG. 6C is an explanatory illustration, outlining the operation of the holding mechanism 200, when the cylindrical cargo 300 is cradled against the inner surface 224 of the receiving member 220 (as shown in FIG. 6A), according to an embodiment of the invention. When the cylindrical cargo 300 is cradled/abutting against the receiving member 220. In the cradled position as shown in the explanatory illustration of FIG. 6C, the foam members, i.e., the upper member 232, the lower member 234, and inner surface 224, being compressed by $\Delta t_1$, $\Delta t_2$, $\Delta t_3$ respectively, which is a fraction of the respective thicknesses $t_1$, $t_2$, and $t_3$. This results in an overall compression of $\Delta t$.

This total $\Delta t$ compression is represented as a segment of the cable 130, shown in FIG. 6C, i.e., the extra distance the cable travels due to the total compression. By travelling this $\Delta t$ distance, the cable 130 provides a reaction time $\Delta s$ for a manual operator to stop the winch 400, and thereby stopping the winding of the cable 130. Thus, in operation, an operator has $\Delta s$ time to stop the winch, which represents the time the cylindrical cargo 300 is initially contacts the receiving member 220 to the time the compression $\Delta t$ is completed. This reaction time may be increased by increasing the thickness of the foam members, i.e., the upper member 232, the lower member 234, and inner surface 224. In other words, a larger t value results in a larger $\Delta t$, resulting in a larger $\Delta s$ reaction time. The greater the reaction time, the greater the ability to stop the winch 400 before any potential damage is done to the cylindrical cargo 300 by pulling it too hard against the receiving member 220. Consequently for the form members outlined above, a foam with an appropriate thickness t is selected so that the cradling process does not damage the cylindrical cargo 300. As outlined above, the cylindrical cargo 300 may be any type of cargo, such as a container, a construction pipe, or a water vessel, having a cylindrical shape. It should be noted that the winch 400 may also be controlled automatically by a controller that utilizes the Δt and Δs variables in programming an automatic cut off for the winch 400.

Figure 7:
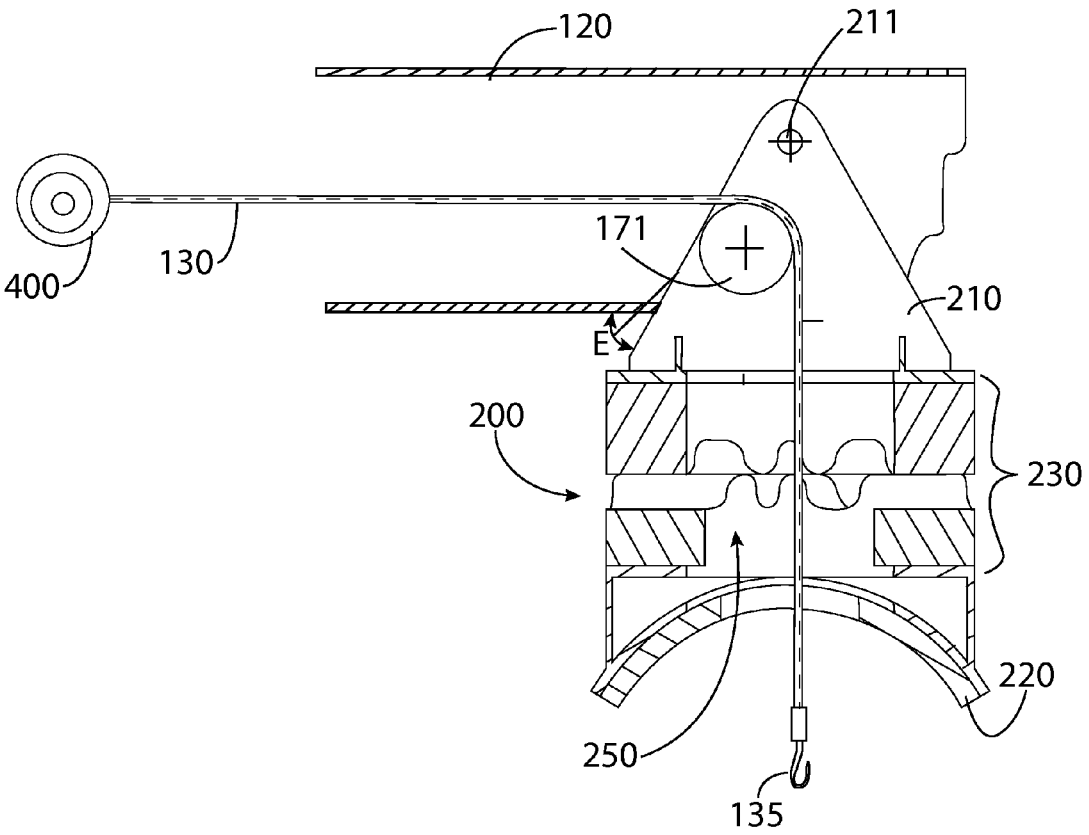
FIG. 7 is an exemplary section view of a holding mechanism attached to a jib for controllably receiving cylindrical cargo, according to an embodiment of the invention.

FIG. 7 is an exemplary section view of the holding mechanism 200 for controllably receiving cylindrical cargo 300 and diminishing undesired motion, according to an embodiment of the invention. The FIG. 7 sectional view is through 5-5' shown in FIG. 4. The FIG. 7 illustration is similar to the illustration of FIG. 5, and thus like elements are referenced by the same numbers used in FIGS. 1-5. Thus, FIG. 7 shows the attachment frame 210, the receiving member 220, and the indexing clutch 230. FIG. 7 also shows each of the attachment frame 210, the receiving member 220, and the indexing clutch 230 having respective central openings, forming a central pathway 250. FIG. 7 shows the cable 130 extending through the central pathway 250. At one end, the cable 130 has a hook 135.

The embodiment of FIG. 7 differs from the illustration of FIG. 5 in that the cable 130 extends from the central pathway 250 in the holding mechanism 200 to a wheel 171 located in the jib 120, the wheel 171 redirecting the path of the cable 130 towards the winch 400. Thus, the cable 130 extends within the jib 120. As with the embodiment of FIG. 5, the hook end of the cable 130 extends out of the receiving member 220.

Regarding the operation of the loading apparatus 100 and holding mechanism 200 as shown in FIG. 7, the operation is also defined as outlined with respect to FIGS. 6A-6C. Thus for example, as illustrated in FIG. 6A, when the winch 400 is activated, the cable 130 running through the jib 120 and central pathway 250, draws the cylindrical cargo 300 upwards until it contacts the foam curved inner surface 224 of the receiving member 220. Also, as with the illustration of FIG. 6C, the FIG. 7 embodiment, because of $\Delta t_1$, $\Delta t_2$, $\Delta t_3$ compressions in the upper member 232, the lower member 234, and inner surface 224, respectively, resulting in an overall compression of Δt. This combined compression translates to a reaction time Δs for a manual operator to stop the winch 400.

Regarding the limiting the motion of the cylindrical cargo 300 as outlined in FIG. 6B, the embodiment of FIG. 7 utilizes the forces T and L, as outlined above. However, the physical structure of the apparatus shown in FIG. 7 also prevents undue rotation of the holding mechanism 200, with respect to the jib 120. FIG. 7 shows, a limited rotation arc E between the jib 120 and the upper plate 232 of the indexing clutch. During the tensioning of the cable 130, the holding apparatus 200 may rotate. However, there is no rotation beyond the arc D, because the upper plate 232 would abut against the jib 120, preventing any further rotation. This feature adds stability to both the apparatus and the loading procedure.

What has been described and illustrated herein are preferred embodiments of the invention along with some variations. The terms, descriptions and figures used herein are set forth by way of illustration only and are not meant as limitations. For example, as stated above, the holding mechanism 200 may be quickly installed when the mission dictates the at-sea recovery of a cylindrical load, such as a water vessel. Thus the standard crane hook may be removed and the holding mechanism 200 may be used by inserting an attachment device, such as a pin 211. Alternatively, the load transfer apparatus 100 may be manufactured with a non-replaceable holding mechanism 200. Also, for example, the indexing clutch 230 may be replaced by mating high friction surfaces that also lock at desired positions thereby clocking the receiving member 220 at a desired angular orientation. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A load transferring apparatus comprising:

a boom;

a jib, wherein the jib is pivotally attached to the boom;

a holding mechanism for controllably receiving cylindrical cargo and diminishing undesired motion of said cylindrical cargo, the holding mechanism comprising:

an attachment frame pivotally attached at a pivot point to the jib;

a receiving member for receiving cylindrical cargo thereon, the receiving member having a curved inner surface, wherein the curved inner surface has a radius of curvature that is substantially equal to the radius of curvature of said cylindrical cargo;

an indexing clutch connected to and between the attachment frame and the receiving member, the indexing clutch comprising;

an upper plate having a bottom surface having a plurality of downward projecting ridges, and a lower plate having a top surface having a plurality of upward projecting ridges for mating with the downward projecting ridges of the upper member to lock the upper plate with respect to the lower member at different positions to clock the receiving member in a desired angular orientation, wherein each of the attachment frame, the upper and lower plates of the indexing arrangement, and the receiving member have a central opening that forms a central pathway, the load transfer apparatus further comprising:

a winch; and a cable having a hook at one end and attached to the winch at another, wherein the cable extends from the winch at one end through the central pathway, with the hook positioned below the receiving member for hooking said cylindrical cargo, and wherein when the winch is activated said cylindrical cargo is pulled against the receiving member, thereby holding said cylindrical cargo against the curved inner surface.

2. The load transferring apparatus of claim 1, wherein a Y axis extends through the central pathway, and wherein each of the upper plate and the lower plate of the indexing arrangement have a circular shape, the upper plate rotatable with respect to the lower plate thereby locking the respective ridges adjusted to rotate the receiving member about the Y axis and to align the receiving member with said cylindrical cargo.

3. The load transferring apparatus of claim 2, wherein each of the upper plate and the lower plate of the indexing clutch, as well as the curved inner surface of the receiving member comprise a foam, wherein when the winch is activated to hold said cylindrical cargo against the curved inner surface of the receiving member, a tension force T is created in the cable as well as a weight force L by said cylindrical cargo, the combination of forces creating a moment M about the pivot point that substantially prevents undesired rotation of the holding mechanism 200 about the pivot point.

4. The load transferring apparatus of claim 3, wherein the upper plate, the lower plate, and the indexing clutch, have thicknesses $t_1$, $t_2$, and $t_3$, respectively, and wherein when the winch pulls said cylindrical cargo against the curved inner surface of the receiving member, the upper plate, the lower plate, and the curved inner surface compress by $\Delta t_1$, $\Delta t_2$, and $\Delta t_3$ respectively, resulting in a total compression of $\Delta t$, wherein $\Delta t$ also represents the distance the cable travels due to the total compression $\Delta t$, which correlates to a reaction time $\Delta s$ for stopping the winch.

5. The load transferring apparatus of claim 4, wherein the holding mechanism further comprises a wheel positioned within the attachment frame, wherein the cable wraps around the wheel, the wheel redirecting the cable from the central pathway towards the winch.

6. The load transferring apparatus of claim 4, wherein the load transfer apparatus further comprises a wheel positioned within the jib, wherein the cable wraps around the wheel, the wheel redirecting the cable from the central pathway and through the jib towards the winch.

7. A holding mechanism for controllably receiving cylindrical cargo and diminishing undesired motion of said cylindrical cargo, the holding mechanism comprising:

an attachment frame pivotally attached at a pivot point to a jib of a load transferring apparatus;

a receiving member for receiving cylindrical cargo thereon, the receiving member having a curved inner surface, wherein the curved inner surface has a radius of curvature that is substantially equal to the radius of curvature of said cylindrical cargo;

an indexing clutch connected to and between the attachment frame and the receiving member, the indexing clutch comprising;

an upper plate having a bottom surface having a plurality of downward projecting ridges, and a lower plate having a top surface having a plurality of upward projecting ridges for mating with the downward projecting ridges of the upper member to lock the upper plate with respect to the lower member at different positions to clock the receiving member in a desired angular orientation, wherein each of the attachment frame, the upper and lower plates of the indexing arrangement, and the receiving member have a central opening that forms a central pathway, the holding mechanism further comprising:

a cable having a hook at one end and attached to a winch at another, wherein the cable extends from said winch at one end through the central pathway, with the hook positioned below the receiving member for hooking said cylindrical cargo, and wherein when said winch is activated said cylindrical cargo is pulled against the receiving member, thereby holding said cylindrical cargo against the curved inner surface.

8. The holding mechanism of claim 7, wherein a Y axis extends through the central pathway, and wherein each of the upper plate and the lower plate of the indexing arrangement have a circular shape, the upper plate rotatable with respect to the lower plate thereby locking the respective ridges adjusted to rotate the receiving member about the Y axis and to align the receiving member with said cylindrical cargo.

9. The holding mechanism of claim 8, wherein each of the upper plate and the lower plate of the indexing clutch, as well as the curved inner surface of the receiving member comprise a foam, wherein when the winch is activated to hold said cylindrical cargo against the curved inner surface of the receiving member, a tension force T is created in the cable as well as a weight force L by said cylindrical cargo, the combination of forces creating a moment M about the pivot point that substantially prevents undesired rotation of the holding mechanism 200 about the pivot point.

10. The holding mechanism of claim 9, wherein the upper plate, the lower plate, and the indexing clutch, have thicknesses $t_1$, $t_2$, and $t_3$, respectively, and wherein when said winch pulls said cylindrical cargo against the curved inner surface of the receiving member, the upper plate, the lower plate, and the curved inner surface compress by $\Delta t_1$, $\Delta t_2$, and $\Delta t_3$ respectively, resulting in a total compression of $\Delta t$, wherein $\Delta t$ also represents the distance the cable travels due to the total compression $\Delta t$, which correlates to a reaction time $\Delta s$ for stopping the winch.

11. The holding mechanism of claim 10, wherein the holding mechanism further comprises a wheel positioned within the attachment frame, wherein the cable wraps around the wheel, the wheel redirecting the cable from the central pathway towards said winch.

* * * * *